US011623812B2

(12) United States Patent
Itano

(10) Patent No.: US 11,623,812 B2
(45) Date of Patent: Apr. 11, 2023

(54) BUFFER MEMBER AND PACKAGE BODY

(71) Applicant: KYOCERA Document Solutions Inc., Osaka (JP)

(72) Inventor: Atsushi Itano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/663,300

(22) Filed: May 13, 2022

(65) Prior Publication Data

US 2022/0380109 A1 Dec. 1, 2022

(30) Foreign Application Priority Data

May 31, 2021 (JP) ..... JP2021-090999

(51) Int. Cl.
*B65D 81/127* (2006.01)
*B65D 85/68* (2006.01)

(52) U.S. Cl.
CPC ..... *B65D 81/127* (2013.01); *B65D 85/68* (2013.01); *B65D 2581/053* (2013.01); *B65D 2585/689* (2013.01)

(58) Field of Classification Search
CPC ..... B65D 81/127; B65D 85/68; B65D 2581/053; B65D 2585/689
USPC ..... 206/591, 594, 320
See application file for complete search history.

(56) References Cited

U.S. PATENT DOCUMENTS 5,322,168 A * 6/1994 Kataoka ..... B65D 5/5035 206/583
6,116,423 A * 9/2000 Troxtell, Jr. ..... B65D 5/248 206/723
2018/0251257 A1* 9/2018 Hasegawa ..... B65D 5/6667
2018/0273273 A1* 9/2018 Takeuchi ..... B65D 5/505
2021/0214145 A1* 7/2021 Kuo ..... B65D 81/058

FOREIGN PATENT DOCUMENTS

JP 2002362540 A 12/2002

* cited by examiner

*Primary Examiner* — Jacob K Ackun
(74) *Attorney, Agent, or Firm* — Alleman Hall Creasman & Tuttle LLP

(57) ABSTRACT

A buffer member provided includes a base portion, and pairs of first buffer portions, second buffer portions, and inclined plate portions. The base portion includes a hollow portion, a lateral base portion defining an upper part of the hollow portion, and a pair of vertical base portions defining both sides of the hollow portion. The first buffer portions are continuous to lower edges of the vertical base portions and protrude outwardly in a first direction. The vertical buffer portions are continuous to the first buffer portions. The second buffer portions include the vertical buffer portions and a pair of upper-extending portions. The upper-extending portions each extend upward from a corresponding one of the vertical buffer portions. The inclined plate portions include engaging portions that are continuous to the pair of upper extending portions, extend obliquely in a second direction, and engage with an edge portion of the lateral base portion.

5 Claims, 6 Drawing Sheets

BUFFER MEMBER AND PACKAGE BODY

INCORPORATION BY REFERENCE

This application is based upon and claims the benefit of priority from the corresponding Japanese Patent Application No. 2021-090999 filed on May 31, 2021, the entire contents of which are incorporated herein by reference.

BACKGROUND

The present disclosure relates to a buffer member to be stored in a package box together with an article to be packed and to a package body including the buffer member.

Spare components for precision equipment such as printers, copiers and multifunctional devices each are stored in a package box and distributed together with a plurality of buffer members as a package body. The plurality of buffer members is disposed inside the package box between the article and the package box.

It is known that the buffer member, which is stored inside the package box together with the article, is made of a cardboard sheet folded into a three-dimensional shape, for example.

SUMMARY buffer member according to one aspect of the present disclosure is made of a cardboard sheet folded into a three-dimensional shape and is stored inside a package box together with an article to be packed. The buffer member includes a base portion, a pair of first buffer portions, a pair of second buffer portions and a pair of inclined plate portions. The base portion includes a hollow portion, a lateral base portion defining an upper part of the hollow portion and a pair of vertical base portions defining both sides of the hollow portion. The pair of first buffer portions is continuous to the base portion. The pair of second buffer portions are continuous to the pair of first buffer portions. The pair of inclined plate portions are continuous to the pair of second buffer portions. The pair of vertical base portions are continuous to both edges of the lateral base portion extending in a first direction via a pair of first creases extending in a second direction which intersects the first direction. The pair of vertical base portions extend downward from the first creases. The pair of first buffer portions h are continuous to lower edges of the pair of vertical base portions via a pair of second creases extending in the second direction. The pair of first buffer portions protrude outwardly in the first direction with respect to the pair of vertical base portions from the corresponding second creases. The pair of second buffer portions include a pair of vertical buffer portions and a pair of upper-extending portions. The pair of vertical buffer portions are continuous to one end edges of the pair of first buffer portions in the second direction via a pair of third creases extending in the first direction. The pair of vertical buffer portions stand upward from the third creases and are disposed outside the vertical base portions in the first direction. The pair of upper-extending portions extend upward from the pair of vertical buffer portions to a position higher than the pair of vertical base portions. The pair of inclined plate portions are continuous to the pair of upper-extending portions via a pair of fourth creases extending vertically along an inner edge of the upper-extending portions in the first direction. The pair of inclined plate portions extend obliquely in the second direction from the fourth crease to a front area of one of the sides of the lateral base portion through above the lateral base portion in the second direction. The pair of inclined plate portions are continuous to each other at the front area via a fifth crease extending vertically. In addition, the pair of inclined plate portions each include an engaging portion that engages with an edge portion of the lateral base portion at a side of the front area.

A package body according to another aspect of the present disclosure includes an article to be packed, the buffer member, and a package box storing the article and the buffer member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

An embodiment of the present disclosure will be described below with reference to the drawings. Note that the embodiment below is merely a specified example of the present disclosure and is not intended to limit the technical scope of the present disclosure.

[Configuration of Package Body 10]

Buffer members 8 according to an embodiment constitute a part of a package body 10. The package body 10 includes an article 100 to be packed, two buffer members 8 and a package box 9.

The package box 9 stores the article 100 and the two buffer members 8. In other words, the two buffer members 8 are stored inside the package box 9 together with the article 100.

Figure 1:
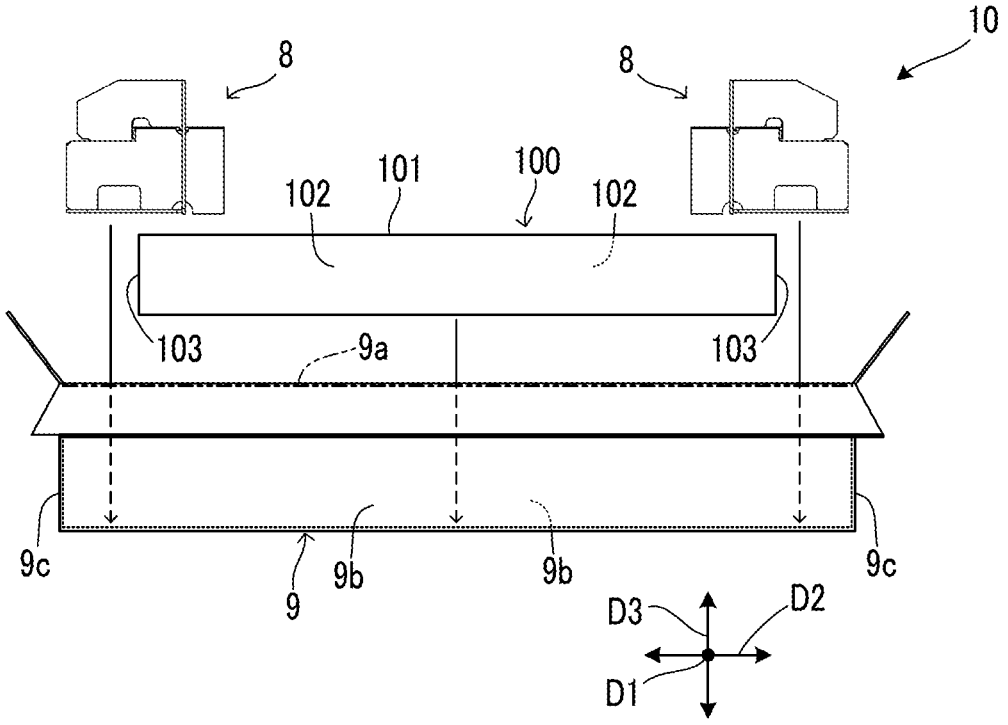
FIG. 1 is an exploded side view of a package body having buffer members according to an embodiment.

In the example shown in FIG. 1, the article 100 is an inner box in which a spare component of an image forming device such as a printer is stored. The inner box is made of a cardboard sheet. The spare component is a drum unit, a developing unit, a toner container, etc., of an electrophotographic image forming device. The drum unit includes a drum-shaped photoconductor and a charging device for charging the photoconductor.

The package box 9 has a rectangular parallelepiped shape. In the following description, the lateral direction of the package box 9 is referred to as a first direction D1 and the longitudinal direction of the package box 9 is referred to as a second direction D2.

The package box 9 includes a top plate 9*a*, a pair of first side plates 9*b*, a pair of second side plates 9*c* and a bottom plate. The top plate 9*a*, the pair of first side plates 9*b* and the bottom plate each have a rectangular shape with a longitudinal direction in the second direction D2.

The top plate 9*a* consists of two flaps joined together with an adhesive tape or staples. The bottom plate has a similar construction.

The pair of first side plates 9*b* face against each other in the first direction D with a distance therebetween. The second side plates 9*c* face against each other in the second direction D2 with a distance between them.

The first and second directions D1, D2 extend in a horizontal direction. The second direction D2 intersects the first direction D1. More specifically, the second direction D2 is orthogonal to the first direction D1. The third direction D3 shown in the drawings indicates a height direction orthogonal to the first and second directions D1, D2.

Figure 2:
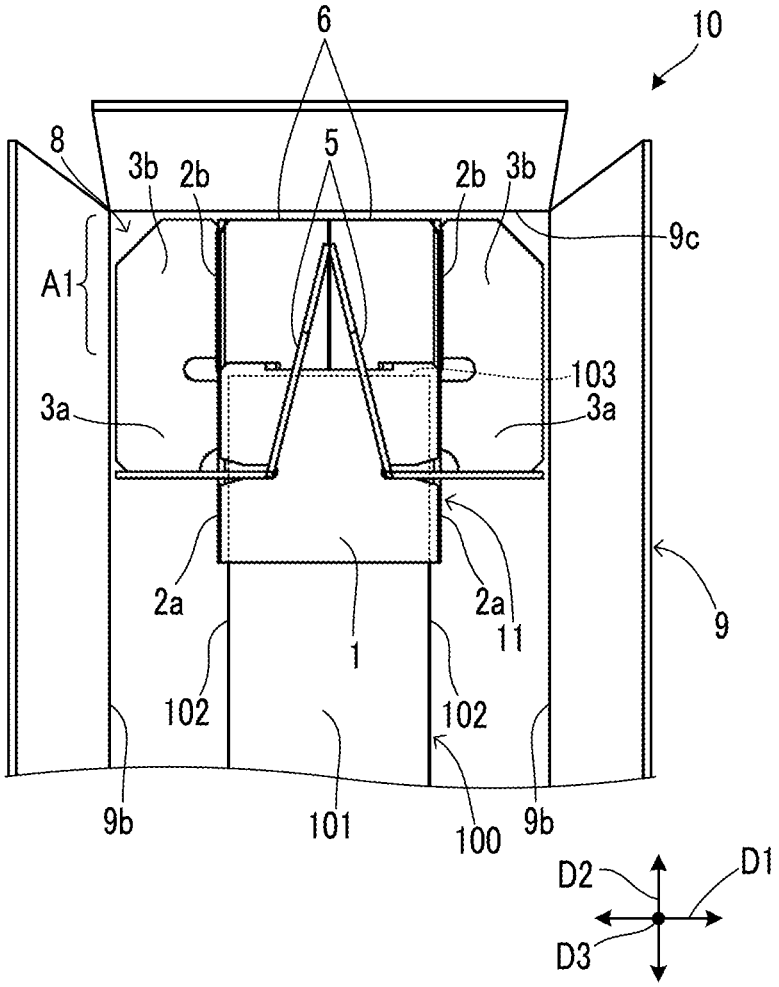
FIG. 2 is a plan view of an end portion of the package body having a buffer member according to the embodiment.

The article 100 includes an upper surface 101, a pair of first side surfaces 102 and a pair of second side surfaces 103 (see FIG. 1 and FIG. 2). The upper surface 101 of the article 100 faces against the inner surface of the top plate 9*a* of the package box 9.

The pair of first side surfaces 102 are the side surfaces of both ends of the article 100 in the first direction D1. The pair of first side surfaces 102 face against the respective inner surfaces of the pair of first side plates 9*b* of the package box 9.

The pair of second side surfaces 103 are the side surfaces of both ends of the article 100 in the second direction D2. The pair of second side surfaces 103 face against the respective inner surfaces of the pair of second side plates 9*c* of the package box 9.

The two buffer members 8 each are disposed between the inner surface of the package box 9 and the outer surface of the article 100. With such an arrangement, the two buffer members 8 restrain movement of the article 100 inside the package box 9 and buffer any shock that the article 100 receives when the package body 10 falls.

Meanwhile, the buffer member 8 is preferably assembled of as small amount of cardboard sheets as possible. In addition, the buffer member 8 is preferably disassembled back to the cardboard sheet as easily as possible after use.

The buffer member 8 is assembled with a cardboard sheet. The buffer member 8 has a structure that can be easily disassembled. The structure thereof will be described below.

[Structure of Buffer Member 8]

The buffer member 8 is made of a cardboard sheet that is folded into a three-dimensional shape.

Figure 3:
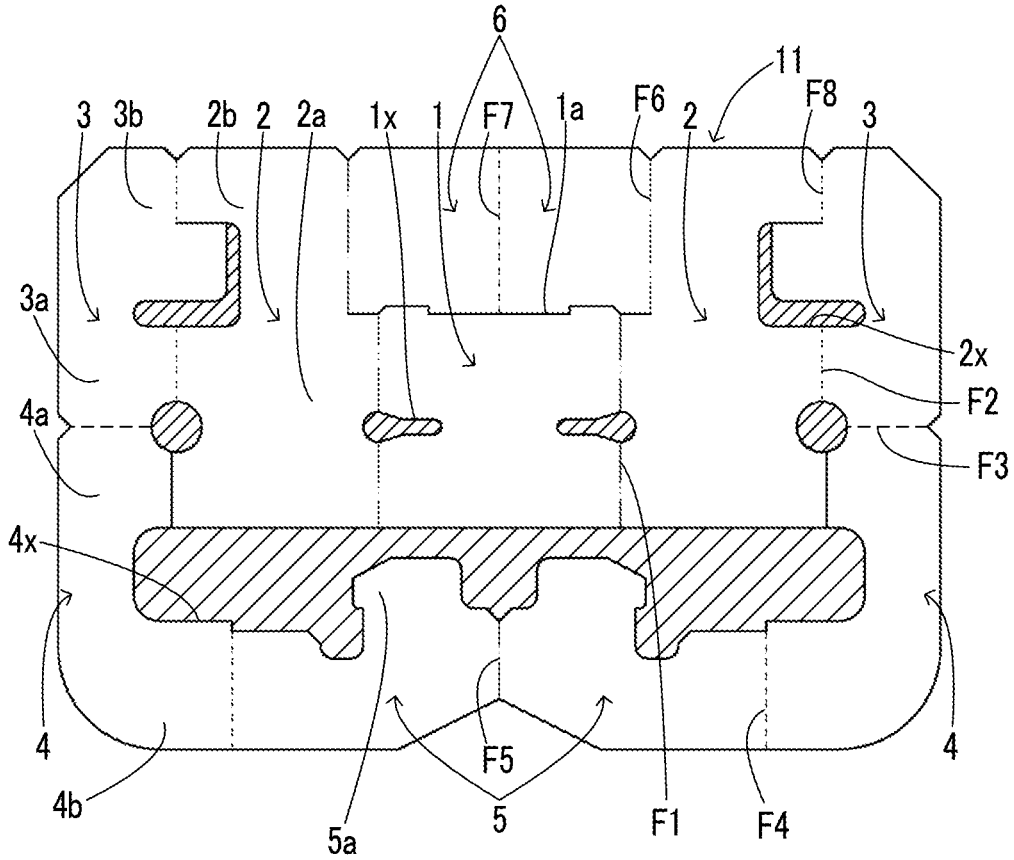
FIG. 3 is an exploded view of the buffer member according to the embodiment.

In the exploded view shown in FIG. 3, the solid lines indicate a contour and cuts of the cardboard sheet. The broken lines indicate creases folded in a valley and the two-dot chain lines indicate creases folded in a mountain. In addition, in FIG. 3, the hatched areas indicate openings formed in the cardboard sheet.

The cardboard sheet shown in FIG. 3 is folded at the creases. Parts of the cardboard sheet engage with other parts of the cardboard sheet. Accordingly, the buffer member 8 is assembled into a three-dimensional shape as shown in FIG. 4 and FIG. 5.

As shown in FIG. 1 and FIG. 2, two buffer members 8 are disposed inside the package box 9 along the respective inner surfaces of the pair of second side plates 9*c*.

Figure 4:
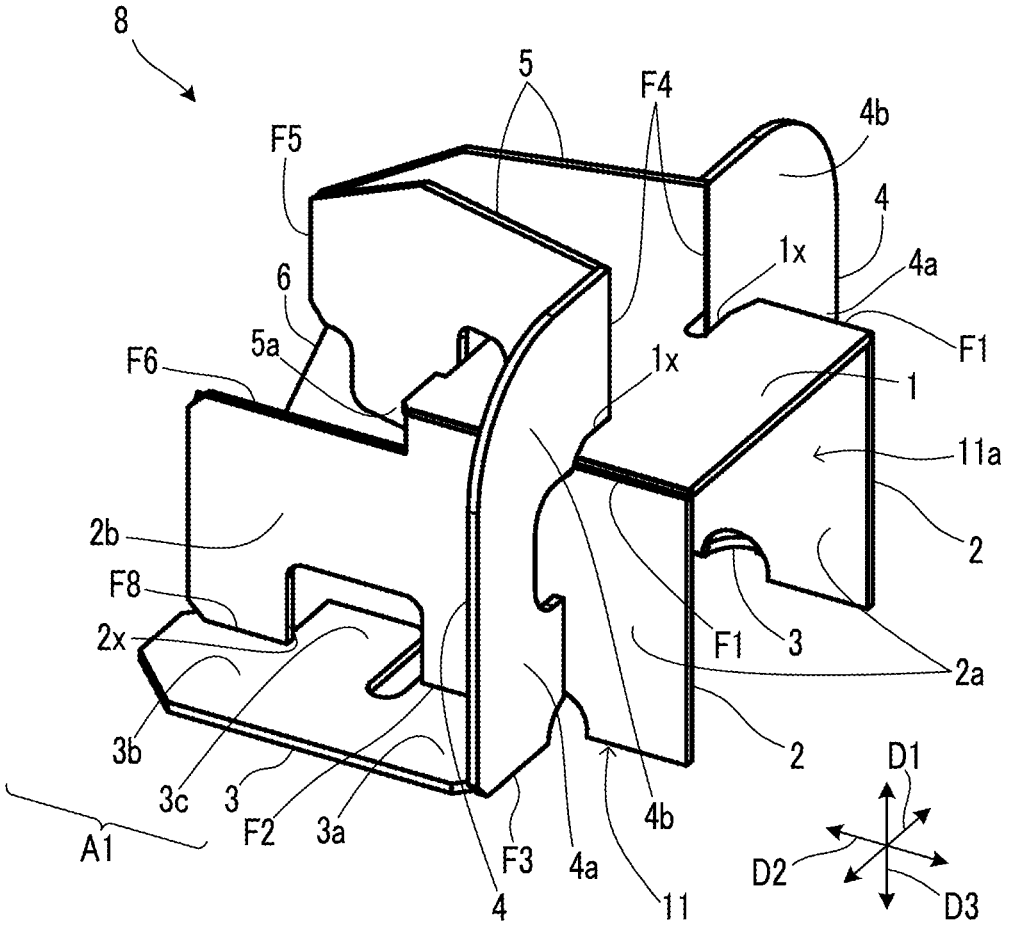
FIG. 4 is a perspective view of the buffer member according to the embodiment.
Figure 5:
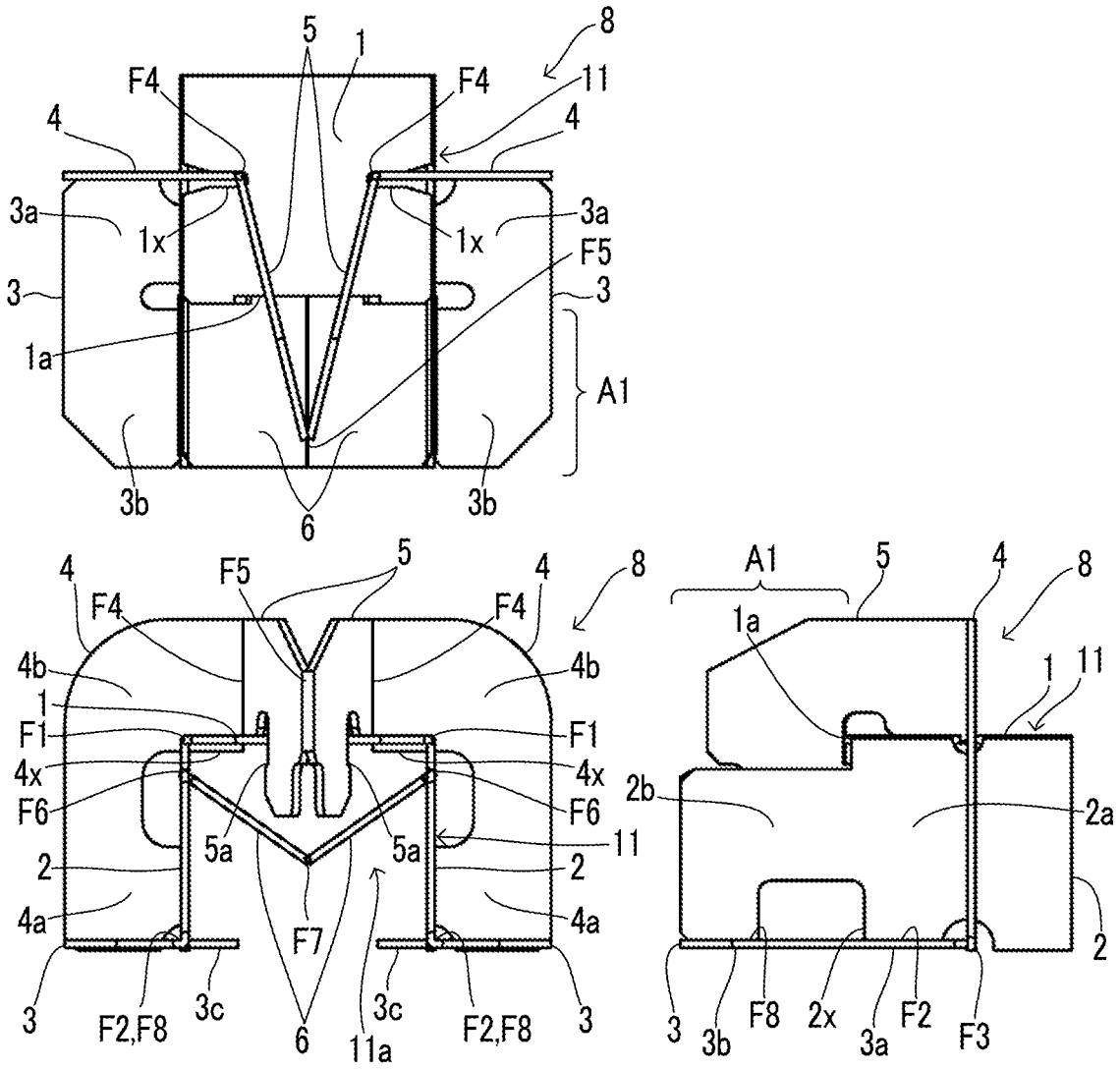
FIG. 5 shows three facial views of the buffer member according to the embodiment.

Each of the buffer members 8 includes a base portion 11, a pair of lateral flange portions 3, a pair of second buffer portions 4 and a pair of inclined plate portions (see FIG. 4 and FIG. 5). The base portion 11 includes three platy portions formed above and both sides of a hollow portion 11*a*. More specifically, the base portion 11 includes a lateral base portion 1 formed above the hollow portion 11*a*. The base portion 11 further includes a pair of vertical plate portions formed at both sides of the hollow portion 11*a*. The lateral base portion 1 defines an upper part of the hollow portion 11*a*. The pair of vertical plate portions 2 define both sides of the hollow portion 11*a*.

The pair of vertical plate portions 2 each include a vertical base portion 2*a* and a first front-extending portion 2*b*. That is, the buffer member 8 includes the pair of vertical base portions 2*a* and the pair of first front-extending portions 2*b*.

The pair of lateral flange portions 3 each include a first buffer portion 3*a*, a second front-extending portion 3*b* and an inner-protrusion portion 3*c*. That is, the buffer member 8 includes the pair of first buffer portions 3*a*, the pair of second front-extending portions 3*b* and the pair of inner-protrusion portions 3*c*.

The pair of second buffer portions 4 each include a vertical buffer portion 4*a* and an upper-extending portion 4*b*. That is, the buffer member 8 includes the pair of vertical buffer portions 4*a* and the pair of upper-extending portions 4*b*.

Figure 6:
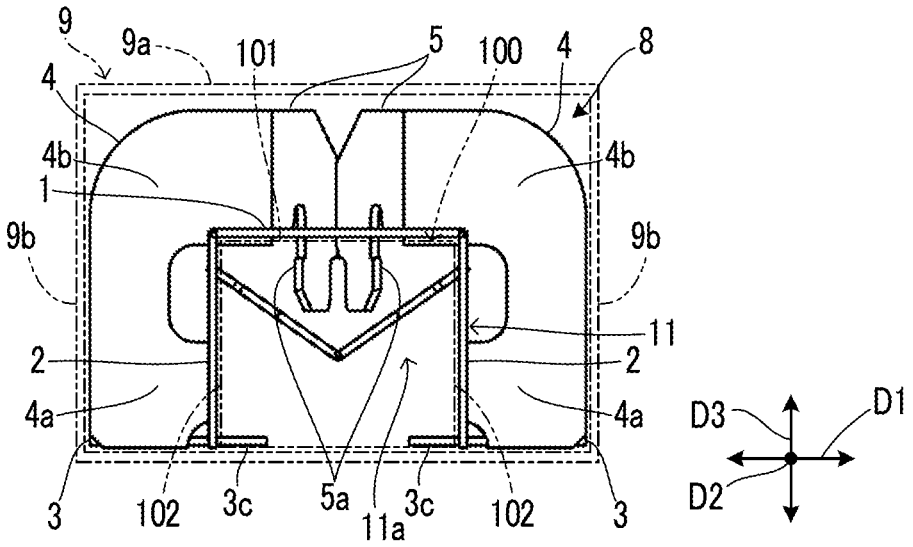
FIG. 6 is a rear view of the buffer member according to the embodiment.

The lateral base portion 1 is a platy portion extending in lateral directions. Here, the lateral directions are directions extending in the first and second directions D1, D2. As shown in FIG. 6, the lateral base portion 1 is disposed along the upper surface 101 of the article 100.

The pair of vertical plate portions 2, the pair of lateral flange portions 3, the pair of second buffer portions 4 and the pair of inclined plate potions 5 also have a platy shape.

The pair of vertical base portions each are continuous to an edge of a corresponding one of the lateral base portion 1 via a corresponding one of a pair of first creases (see FIG. 4 and FIG. 5). The pair of first creases extend in the second direction D2.

The pair of vertical base portions 2*a* extend downward from the pair of first creases F1 (see FIG. 4 and FIG. 5). The pair of vertical base portions 2*a* are disposed along the pair of first side surfaces of the article 100 (see FIG. 2 and FIG. 7).

The buffer members 8 are placed in the package box 9 from above so that end portions of the article 100 inside the package box 9 fit the hollow portions 11*a* defined by the base portions 11.

The pair of first buffer portions 3*a* each are continuous to a lower edge of a corresponding one of the pair of vertical base portions via a corresponding one of a pair of second creases F2 (see FIG. 4 and FIG. 5). The pair of second creases extend in the second direction D2.

The pair of first buffer portions 3*a* each protrude outwardly of a corresponding one of the pair of vertical base portions 2*a* from a corresponding one of a pair of second creases F2 in the first direction D1 (see FIG. 4 and FIG. 5).

The pair of first buffer portions 3*a* each are disposed between a corresponding one of the pair of first side surfaces 102 of the article 100 and an inner surface of a corresponding one of the pair of first side plates of the package box 9 (see FIG. 2). Outer ends in the first direction D1 of the pair of first buffer portions 3*a* each abut an inner surface of a corresponding one of the first side plates 9*b* of the package box 9 in the package body 10.

The pair of vertical buffer portions 4*a* each are continuous to an edge of a corresponding one of the pair of first buffer portions 3*a* in the second direction D2 via a corresponding one of a pair of third creases F3 (see FIG. 4 and FIG. 5). The pair of third creases extend in the first direction D1.

The pair of vertical buffer portions 4*a* each are continuous to an edge of a corresponding one of the pair of first buffer portions 3*a* in the second direction D2 via a corresponding one of the pair of third creases F3 (see FIG. 4 and FIG. 5). The third creases F3 extend in the first direction D1. The pair of vertical buffer portions 4*a* each stand upward from a corresponding one of the pair of third creases F3.

The pair of vertical buffer portions 4*a* each extend upward from a corresponding one of the pair of third creases F3 (see FIG. 4 and FIG. 5). The pair of vertical buffer portions 4*a* each abut an outside of a corresponding one of the pair of vertical base portions 2*a* in the first direction D1.

The pair of vertical buffer portions 4*a* each are disposed between a corresponding one of the pair of vertical base portions 2*a* and an inner surface of a corresponding one of the pair of first side plates 9*b* of the package box 9. In other words, the pair of vertical base portions 2*a* each and the pair of vertical buffer portions 4*a* each are respectively disposed between a corresponding one of the pair of first side surfaces 102 of the article 100 and the inner surface of a corresponding one of the pair of first side plates 9*b* of the package box 9.

In the package body 10, each of outer ends of the pair of vertical buffer portions 4*a* in the first direction D1 abuts a corresponding one of the pair of first side plates 9*b* of the package box 9. Each of inner ends of the pair of vertical buffer portions 4*a* in the first direction D1 abuts a corresponding one of the pair of vertical base portions 2*a*. Furthermore, upper ends of the pair of upper-extending portions 4*b* abut the top plate 9*a* of the package box 9.

The pair of upper-extending portions 4*b* each extend upward from a corresponding one of the pair of vertical base portions 2*a* to a position higher than the pair of vertical base portions 2*a* (see FIG. 4 to FIG. 6). That is, the pair of upper-extending portions 4*b* each extend upward from a corresponding one of the pair of vertical buffer portions 4*a* to a position higher than the pair of first creases F1.

The pair of upper-extending portions 4*b* each are formed to turn around from an outer-side area to an inner-side area of a corresponding one of the pair of vertical base portions 2*a* in the first direction D1 (FIG. 4 to FIG. 6).

Figure 7:
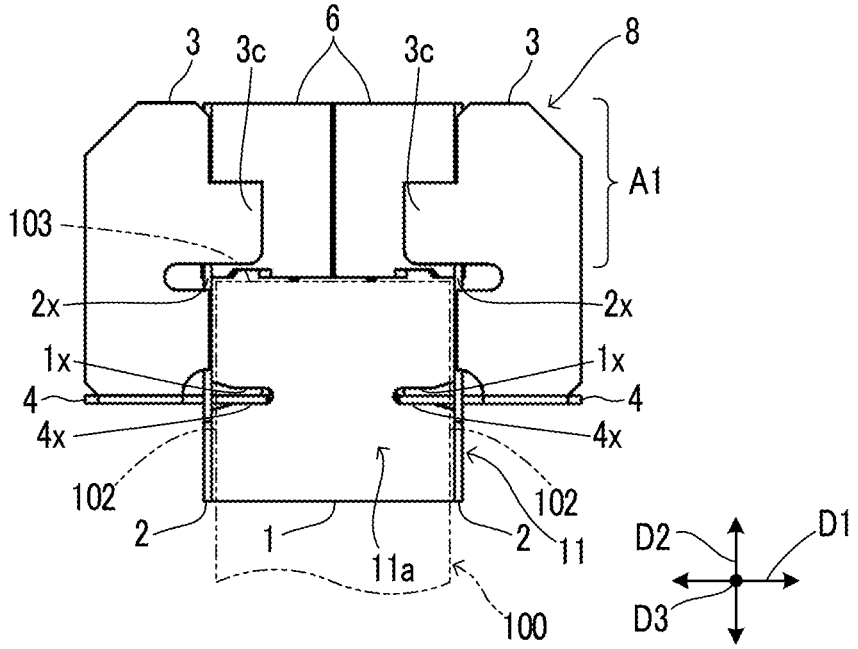
FIG. 7 is a bottom view of the buffer member according to the embodiment.

The lateral base portion 1 has a pair of slits 1*x* extending in the first direction D1 (see FIG. 4 and FIG. 7). The pair of upper-extending portions 4*b* each have a fitting portion 4*x* that fits into a corresponding one of the pair of slits 1*x*. Each fitting portion 4*x* is a lower edge portion of a section of the corresponding upper-extending portion 4*b* that is formed to turn around to the inner-side area of the corresponding vertical base portion 2*a*.

The pair of inclined plate portions 5 each are continuous to an inner-side edge of a corresponding one of the pair of upper-extending portions 4*b* in the first direction via a corresponding one of fourth creases F4 (see FIG. 4 and FIG. 5). The fourth creases F4 each extend vertically. In other words, the fourth creases F4 each extend in the third direction D3.

The pair of inclined plate portions 5 each incline from the corresponding fourth crease F4 in the second direction D2 above the lateral base portion 1 and extend to the front area A1 (see FIG. 4 and FIG. 5). The front area A1 is a zone at one side of the lateral base portion 1 in the second direction D2. The upper ends of the pair of inclined plate portions 5 abut the top plate 9*a* of the package box 9 in the package body 10.

The pair of inclined plate portions 5 are continuous to each other in the front area A1 via a fifth crease F5 extending vertically (see FIG. 4 and FIG. 5). The pair of inclined plate portions 5 each include an engaging portion 5*a* that engages with an edge portion 1*a* of the lateral base portion 1 at a side of the front area A1.

The pair of first front-extending portions 2*b* each extend from a corresponding one of the pair of vertical portions 2*a* to the front area A1 in the second direction D2 (see FIG. 4 and FIG. 5).

A pair of third buffer portions 6 each are continuous to an upper edge of a corresponding one of the pair of first front-extending portions 2*b* via a corresponding one of sixth creases F6 (see FIG. 4 and FIG. 5). The sixth creases F6 each extend in the second direction D2.

The pair of third buffer portions 6 each extend obliquely downward from the corresponding sixth crease F6 in the front area A1 (see FIG. 5). The pair of third buffer portions 6 are continuous to each other via a seventh crease F7 extending in the second direction D2.

The pair of third buffer portions 6 each are disposed between a corresponding one of the pair of second side surfaces 103 of the article 100 and an inner surface of a corresponding one of the pair of second plates 9*c* of the package box 9 (see FIG. 2 and FIG. 7).

The pair of second front-extending portions 3*b* each extend from a corresponding one of the pair of first buffer portions 3*a* to the front area A1 in the second direction (see FIG. 4, FIG. 5 and FIG. 7). The pair of second front-extending portions 3*b* each are continuous to a lower edge of a corresponding one of the pair of first front-extending portions 26 via a corresponding one of a pair of eighth creases F8 (see FIG. 5). The eighth creases F8 each extend in the second direction.

The pair of second front-extending portions 3*b* are lower than the pair of vertical base portions 2*a* (see FIG. 4 and FIG. 5). That is, the height between the second crease F2 and the first crease F1 is shorter than the height between the eight crease F8 to sixth crease F6.

The pair of inner-protrusion portions 3*c* each extend from a corresponding one of the pair of second front-extending portions 3*b* to below a corresponding one of the pair of third buffer portions 6 (FIG. 4 to FIG. 7). The pair of first front-extending portions 2*b* each have at the lower end thereof a notch portion 2*x* through which a corresponding one of the pair of inner-protrusion portions 3*c* passes (see FIG. 4, FIG. 5 and FIG. 7).

In the buffer member 8 employed, disengagement of the engaging portions 5*a* from the edge portion 1*a* of the lateral base portion 1 allows disassembling of the buffer member 8 back to the original cardboard sheet.

FIG. 1, FIG. 2 and FIG. 4 to FIG. 7 show the first, second and eighth creases F1, F2, F8 each having a right angle, for convenience. The first, second and eighth creases F1, F2, F8, however, each have an obtuse angle when the buffer member 8 is in a natural state of not receiving external force.

Thus, in the natural state, the buffer member 8 is wider in the first direction D1 than in a state shown in the drawings. The outer dimension of the buffer member 8 in the first direction D1 in the natural state is greater than the inner dimension of the package box 9 in the first direction D1.

When the buffer member 8 is in the natural state, the engaging portions 5*a* engage the edge portion 1*a* of the lateral base portion 1.

The buffer member 8 contracts in the first direction D1 when the pair of vertical plate portions 2 are grabbed by hand. This enables the buffer member 8 to be easily placed inside the package box 9.

After the buffer member 8 is placed inside the package box 9, the pair of vertical plate portions 2 are released from the hand. After release, the buffer member 8 expands in the first direction by its elasticity. Here, the buffer member 8 expands in the first direction D1 until the outer ends of the pair of first buffer portions 3*a* abut the inner surfaces of the pair of first side plates 9*b* of the package box 9 in the first direction D1.

Furthermore, when the buffer member 8 contracted in the first direction D1 is placed inside the package box 9, the pair of second buffer portions 4 come closer to each other and the pair of inclined plate portions 5 move to the side of the pair of third buffer portions 6. With this, the engaging portions 5*a* disengage from the edge portion 1*a* of the lateral base portion 1.

The buffer members 8 are fitted in between the article 100 and the package box 9. In this state, the article 100 and the package box 9 restrain the buffer member 8 from being deformed.

On the other hand, when a buffer member 8 is removed from inside the package box 9, the pair of inclined plate portions 5 are grabbed by hand. Then, the pair of inclined plate portions 5 are lifted up by the hand. With this, the buffer member 8 is lifted outside the package box 9 while the engaging portions 5*a* are disengaged from the edge portion 1*a* of the lateral base portion 1. As a result, the buffer member 8 develops when it is lifted outside the package box 9. Thus, no particular disassembling operation is required.

Each buffer member 8 is made of a cardboard sheet. This makes it easy to handle the cardboard sheet after disassembling.

The pair of vertical base portions 2*a*, the pair of first buffer portions 3*a* and the pair of vertical buffer portions 4*a* perform a buffering function for the article 100 in the first direction D1.

The fitting structure including the pair of slits 1*x* and the pair of fitting portions 4*x* holds the pair of upper-extending portions 4*b* at a desired position.

In addition, the lateral base portion 1 and the pair of inclined plate portions 5 perform a buffering function for the article 100 in the upper direction. Similarly, parts of the pair of upper-extending portions 4*b* located at the inner areas of the pair of vertical base portions 2*a* perform a buffering function for the article 100 in the upper direction.

Furthermore, the pair of third buffer portions 6 perform a buffering function for the article 100 in the second direction D2. Also, the pair of inner-protruding portions 3*c* perform a buffering function for the article 100 in the second direction D2.

The ridge-line portions of the third creases F3 in the first direction D1 reinforce the first buffer portions 3*a* and the vertical buffer portions 4*a* in the first direction D1. With this, the first buffer portions 3*a* and the vertical buffer portions 4*a* exhibit a sufficient buffering ability in the first direction D1.

Similarly, the ridge-line portions of the seventh creases F7 in the second direction D2 reinforce the pair of third buffer portions 6 in the second direction D2. This makes the pair of third buffer portions 6 exhibit a sufficient buffering ability in the second direction D2.

Likewise, the ridge-line portions of the fourth creases F4 in the third direction D3 reinforce the upper-extending portions 4*b* and the inclined plate portions 5 in the third direction D3. Accordingly, the upper-extending portions 4*b* and the inclined plate portions 5 exhibit a sufficient buffering ability.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A buffer member made of a cardboard sheet folded into a three-dimensional shape and to be placed inside a package box together with an article to be packed, the buffer member comprising:

a base portion including a hollow portion, a lateral base portion, and a pair of vertical base portions, the lateral base portion defining an upper part of the hollow portion, the pair of vertical base portions defining both sides of the hollow portion;

a pair of first buffer portions continuous to the base portion;

a pair of second buffer portions continuous to the pair of first buffer portions; and a pair of inclined plate portions continuous to the pair of second buffer portions;

wherein the pair of vertical base portions are continuous to both edges of the lateral base portion in a first direction via a pair of first creases extending in a second direction intersecting the first direction, the pair of vertical portions extending downward from the pair of first creases;

wherein the pair of first buffer portions are continuous to lower edges of the pair of vertical base portions via a pair of second creases extending in the second direction, the pair of first buffer portions protruding outwardly in the first direction with respect to the pair of vertical base portions from the pair of second creases;

wherein the pair of second buffer portions include:

a pair of vertical buffer portions continuous to one end edges of the pair of first buffer portions in the second direction via a pair of third creases extending in the first direction, the pair of vertical buffer portions standing upward from the pair of third creases, the pair of vertical buffer members disposed outside the pair of vertical base portions in the first direction; and a pair of upper-extending portions extending upward from the pair of vertical buffer portions to a position higher than the pair of vertical base portions;

wherein the pair of inclined plate portions are continuous to the pair of upper-extending portions via a pair of fourth creases extending vertically along an inner edge of the upper-extending portions in the first direction, the pair of inclined plate portions extending obliquely in the second direction from the pair of fourth crease to a front area of one of the sides of the lateral base portion through above the lateral base portion in the second direction, the pair of inclined plate portions being continuous to each other at the front area via a fifth crease extending vertically; and wherein the pair of inclined plate portions each include an engaging portion that engages with an edge portion of the lateral base portion at a side of the front area.

2. The buffer member of claim 1 further comprising:

a pair of first front-extending portions extending from the pair of vertical base portions to the front area in the second direction; and a pair of third buffer portions each continuous to upper edges of the pair of first front-extending portions via a pair of sixth creases extending on the upper edges in the second direction, the pair of third buffer portions extending obliquely downward from the pair of sixth creases, the pair of first front-extending portions being continuous to each other via a seventh crease extending in the second direction.

3. The buffer member of claim 2 further comprising:

a pair of second front-extending portions extending from the pair of first buffer portions in the second direction and continuous to lower edges of the first front-extending portion via a pair of eight creases; and a pair of inner protruding portions extending from the pair of second front-extending portions to below the pair of third buffer portions.

4. The buffer member of claim 1, wherein the lateral base portion includes a pair of slits extending in the first direction, and wherein the pair of upper-extending portions include a pair of fitting portions that fit the pair of slits.

5. A package body comprising:

an article to be packed;

the buffer member of claim 1; and a package box storing the article and the buffer member.

* * * * *